United States Patent [19]

Kotlyar

[11] Patent Number: 4,771,408

[45] Date of Patent: Sep. 13, 1988

[54] UNIVERSAL MUD PULSE TELEMETRY SYSTEM

[75] Inventor: Oleg Kotlyar, Salt Lake City, Utah

[73] Assignee: Eastman Christensen, Salt Lake City, Utah

[21] Appl. No.: 93,724

[22] Filed: Sep. 8, 1987

Related U.S. Application Data

[62] Division of Ser. No. 845,938, Mar. 31, 1986, Pat. No. 4,703,461.

[51] Int. Cl.[4] ..... H04H 9/00

[52] U.S. Cl. ..... 367/83; 367/84; 367/85; 175/40

[58] Field of Search ..... 367/81, 83, 84, 85; 340/853; 175/50, 40, 45

[56] References Cited

U.S. PATENT DOCUMENTS 3,302,457 2/1967 Mayes ..... 367/83

4,641,289 2/1987 Jürgens ..... 367/85

*Primary Examiner*—Charles T. Jordan

*Assistant Examiner*—John W. Eldred

*Attorney, Agent, or Firm*—Beehler, Pavitt, Siegemund, Jagger, Martella & Dawes

[57] ABSTRACT

Multistate mud pulsing is achieved by generating both positive and negative pulses within a drill string by means of a plurality of selectively operable bypass passages around a restriction to primary mud flow within a drill string or by venting to outside of the drill string. A fraction of the hydraulic mud is drawn from a location upstream from the restriction into a valve manifold. The removed fraction of hydraulic mud is selectively communicated from the valve manifold either to a point inside a drill string downstream from the restriction or to a point exterior to the drill string in annulus between the outside of the drill string in the borehole. Mud reinjected downstream from the restriction creates a positive pressure pulse within the drill string. Mud which is diverted to the annulus outside of the drill string creates a negative mud pulse within the drill string. Selective activation of valving for distributing the mud downstream from the restriction or to the exterior drill string annulus allows the apparatus to be used as a simple positive pressure pulse telemetry system, a simple negative pressure telemetry system or a multistate mud pulse telemetry system.

10 Claims, 4 Drawing Sheets

POSITIVE PULSES

MINIMUM POSITIVE PULSES

NEGATIVE PULSES

MAXIMUM NEGATIVE PULSES

DOUBLED PULSES

UNIVERSAL MUD PULSE TELEMETRY SYSTEM

This is a division of application Ser. No. 845,938, filed Mar. 31, 1986, now U.S. Pat. No. 4,703,461.

BACKGROUND OF THE INVENTION

1. Field of the Invention

The invention relates to a method and apparatus for transmitting signals from the bottom of a well bore to the surface by means of mud pressure pulses generated within the hydraulic flow in the drill string.

2. Description of the Prior Art

The desirability of telemetry systems for transmitting downhole information while drilling through the mud column in the drill string has long been recognized. Equipment and procedures for control and monitoring of mud flow parameters are widespread and readily understood in the industry. Therefore, the use of propagating mud pulses through the drill string for the purpose of communicating information from the down hole location while drilling to the well's surface is also widely used and understood.

Prior art mud pulsing-devices are generally classified in one of two categories. Either, the device generates positive pressure pulses or increases of pressure within the drill string over a defined basal level, or generates negative pressure pulses or decreases of the pressure for the drill string. Le Peuvedic, et al., "Hydraulic Controlled Device For Modulating the Mud", U.S. Pat. No. 3,737,843, is an example of a positive pulsing mud valve. A needle valve is mechanically coupled to a piston motor in Le Peuvedic. The needle valve acts against a fixed seat. The piston motor in turn receives the continuous flow of control fluid. Information is transmitted to the surface in the form of rapid pressure variations ranging from 5 to 30 bars and succeeding one another at intervals of 1–30 seconds. Each pressure pulse is generated by reversing an electric current passing through a solenoid coil which is coupled to the needle valve.

Arps, "Earth Well Borehole and Logging System", U.S. Pat. No. 2,925,251, is also directed to a positive pulse telemetry system. A current pulse is applied to a magnet of a control valve. Activation of the valve by the magnet causes an increase in pressure in a cavity outside the valve body. The valve body fluxes and propagates a pressurized signal into the mud stream. Thus, Arps shows a positive pressure pulse system which is operated by several valves.

Spindler, "Pilot Operated Mud Pulse Valve", U.S. Pat. No. 3,9588,217, is also directed to a positive mud pulse telemetry system. In the absence of the generation of mud pulses, the mud flows through an upstream collar through a valve into an annular passage. Mud flows through interior passageways parallel to the main mud stream past a pilot valve seat and through a number of passages to rejoin the main mud flow. Therefore, by actuation of the bypass of valving, positive mud pulses can be generated in the main flow.

Gearhart, et al., "Downhole Signaling System", U.S. Pat. No. 3,964,556, is yet another example of a positive mud pulse telemetric system.

Westlake, et al., "Method of and Apparatus for Telemetry Information From a Point in a Well Borehole to the Earth's Surface," U.S. Pat. No. 4,780,620, shows a negative mud pulse system. A motor driven valve is open in response to binary signals generated by an package downhole. Upon opening a portion of the mud flow is allowed to escape from the drill string to the annulus between the drill string and borehole.

However, each of the prior art systems are binary mud pulse systems capable of generating a mud pulse either above or below a basal pressure rate which is characterized as a normal pressure. However, downhole telemetering systems have to be able to transmit a huge volume of downhole information regarding the nature of the drilled formations, directional ilnformation, and conditions of the borehole.

Therefore, what is needed is a system and method for selectively providing a pulsing telemetry best suited for the application on hand and further capable of providing telemetric information with a signal protocol more efficient than prior art binary systems, which will provide significantly increased data rates.

BRIEF SUMMARY OF THE INVENTION

The invention is a method of multistate generation of mud pulsed telemetered signals comprising the steps of primarily flowing hydraulic mud through a restriction in a drill string, and a plurality of steps of selectively and secondarily bypassing a fraction of the hydraulic mud from the primary flow to a point downstream from the restriction. The fraction of the primary flow is either selectively bypassed to the point downstream from the restriction within the drill string, or the fraction of the primary flow is selectively bypassed to the point downstream from the restriction outside of the drill string, By reason of this combination of steps a plurality of ressure states is defined within the drill string according to the combinations of the step of selectively bypassing the restriction.

In particular in the step of selectively bypassing. the restriction by the fraction of primary flow, the fraction of primary flow is bypassed only to the point within the drill string, so that positive mud pulse signals are telemetered.

In another embodiment in the step of selectively bypassing the fraction of primary flow, the fraction of primary flow is bypassed periodically to the point outside drill string, so that negative mud pulse signals are telemetered.

In a third embodiment in the step of selectively bypassing, the fraction of flow is selectively bypassed either to the point within the drill string or periodically to the point outside the drill string, but never simultaneously to both the points, so that a three state mud pulse signal is telemetered.

In a fourth embodiment in the step of selectively bypassing the restriction, the fractional flow is selectively and periodically bypassed to the point within the drill string, selectively and periodically bypassed to the point outside the drill string, or selectively simultaneously bypassed to both the points, so that a four state mud pulse signal is telemetered.

In yet another embodiment the step of selectively bypassing further comprises the steps of selectively bypassing the fraction flow to at least one of a plurality of points outside the drill string.

In yet another embodiment the steps of selectively bypassing the restriction comprises the step of selectively bypassing the fractional flow to only one point among the plurality of points outside the drill string and among the plurality of points inside the drill string.

The invention is also defined as an apparatus for generating multistate mud pulse telemetry signals comprising a mechanism for restricting primary flow through the drill string, and a mechanism for selectively reducing restriction of the primary flow. The mechanism for reducing restriction of primary flow comprises a mechanism for selectively maintaining the primary flow within the drill string and a mechanism for selectively diverting a fraction of the primary flow from the drill string. As a result, multistate hydraulic pulses are generated in the primary flow within the drill string.

In one embodiment the mechanism for reducing either selectively maintains the flow within the drill string or selectively diverts a fraction of the flow from the drill string, but does not simultaneously maintain the flow and divert the fraction of the flow.

In another embodiment the mechanism for reducing selectively maintains the flow within the drill string and selectively diverts a fraction of the flow from the drill string so as to selectively simultaneously maintain the flow and divert the fraction of the flow.

In still a further embodiment the mechanism for reducing comprises a plurality of mechanisms for selectively maintaining at least a fraction of the primary flow within the drill string. Similarly the mechanism for reducing comprising a plurality of mechanisms for selectively diverting a corresponding plurality of fractional portions of the flow from the drill string.

The invention is additionally characterized as a method of generating multistate mud pulses within a drill string comprising the steps of restricting primary flow of hydraulic mud through the drill string; selectively withdrawing a fractional portion of hydraulic mud flowing through the drill string prior to the step of restricting the removed portion of the hydraulic mud; and selectively recombining the removed fraction of the hydraulic mud removed from the drill string with the remaining portion of the hydraulic mud within the drill string after flow of the remaining portion of the hydraulic mud has been subject to the step of restricting.

In this method the step of selectively combining the removed portion of the hydraulic mud with the remaining portion of the hydraulic mud occurs in a proximate region within the drill string adjacent to that region within the drill string where the step of restricting the remaining portion of the hydraulic mud occurs.

The method may further comprise the step of selectively diverting at least the portion of the fraction of mud selectively removed from the flow within the drill string. The portion is selectively diverted outside of drill string leaving a diminished flow of hydraulic mud through the drill string.

Depending on the embodiment, the steps of selectively combining and selectively diverting are either nonsimultaneously or simultaneously performed.

Figure 1:
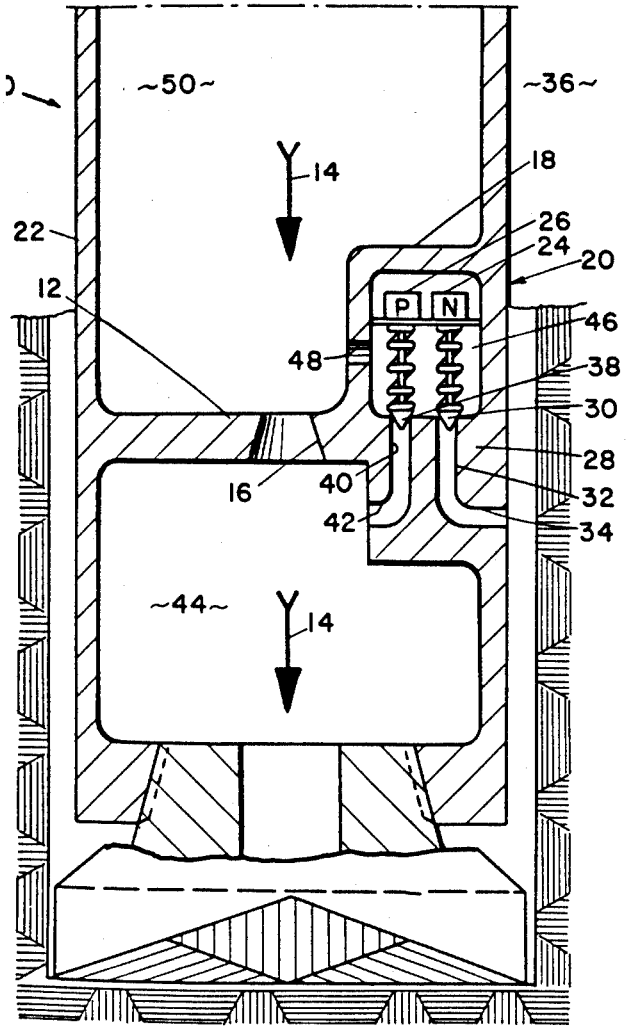
FIG. 1 is a diagrammatic cross-sectional depiction of a drill string incorporating the invention.

The invention and its various embodiments maybe better understood by now turning to the following detailed description.

DETAILED DESCRIPTION OF THE PREFERRED EMBODIMENT

Multistate mud pulsing is achieved by generating both positive and negative pulses within a drill string by means of a plurality of selectively operable bypass passages around a restriction to primary mud flow within a drill string. A fraction of the hydraulic mud is drawn from a location upstream from the restriction into a valve manifold. The removed fraction of hydraulic mud is selectively communicated from the valve manifold either to a point within a drill string downstream from the restriction or to a point exterior to the drill string in annulus between the outside of the drill string in the borehole. Mud reinjected downstream from the restriction creates a positive pressure pulse within the drill string. Mud which is diverted to the annulus outside of the drill string creates a negative mud pulse within the drill string. Selective activation of valving for distributing the mud downstream from the restriction or to the exterior drill string annulus allows the apparatus to used as a simple positive pressure pulse telemetry system, a simple negative pressure telemetry system or a multistate mud pulse telemetry system. A system capable of three or four state telemetry is comprised of a single bypass passage for diverting a portion of hydraulic mud from the main flow in the drill string, and a single bypass passage for recombining it with the main flow downstream from the restriction within the drill string. Depending upon nonsimultaneous or simultaneous operation of the passages, a three or four state telemetry system is provided.

The invention is directed to an apparatus and a methodology which selectively produces both positive and negative mud pulses within a drill string, and secondly is directed to a multistate system capable of more than two states of pressure by which to represent telemetric information. In the illustrated embodiments three to four distinguishable pressure states are depicted, although in theory the number of states can be arbitrarily increased.

The invention comprises a restriction in the primary hydraulic flow within the drill string and a plurality of bypass valves, each having an intake upstream from the restriction and an output either downstream from the restriction within the drill string or an output exterior to the drill string. The plurality of valves can be selectively operated by hydraulic, mechanical or electromechanical means to create positive or negative pressure pulses at a corresponding plurality of distinguishable pressure states within the drill string. For example, positive or negative pressure pulses can be created by summing all valves bypassing fluid to the annulus or by summing all valves bypassing fluid around the restriction. Intermediate multistates can be generated by algebraically summing combinations of such valves. Thereby, the rates of information telemetry are substantially increased over those achieved by prior art binary systems. Where desired, the present invention may be practiced in the same manner as either a positive or negative binary system.

Figure 2:
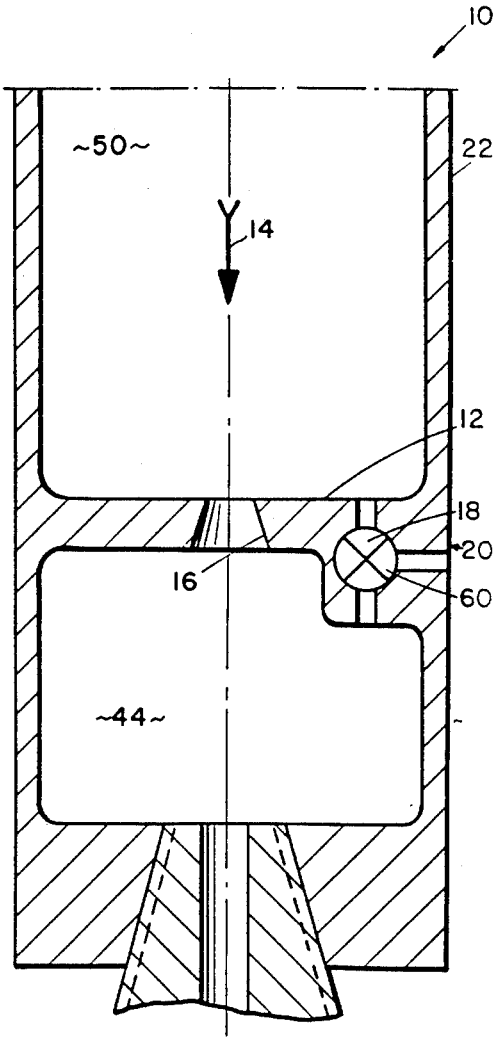
FIG. 2 is a diagrammatic cross-sectional depiction of a second embodiment of a drill string incorporating the invention.

FIG. 1 shows a positve valve 26 and a negative valve 24 in closed position. FIG. 2 diagrammatically shows another embodiment of a multistate valve which is denoted as a rotatable valve.

The invention and its various embodiments may be better understood by turning specifically to the diagrammatic depiction of the portion of the drill string, generally denoted by reference numeral 10, as shown in FIGS. 1 and 2. FIGS. 1 and 2 show the diagrammatic cross-sectional view of drill string 10 wherein a restriction 12 is symbolically depicted in drill string 10. Restriction 12 is in the path of the primary flow of hydraulic mud to the drill string, symbolically represented by arrow 14. Restriction 12 is characterized by a reduced flow area within drill string 10 as defined, for example, by an axial concentric aperture 16 defined through restriction 12.

Restriction 12 is of such characteristic with respect to the overall hydraulic performance of drill string 10 that, without more, restriction 12 determines the basal flow rate in the pressure within the drill string.

Drill string 10 includes a valving mechanism, generally denoted by reference numeral 18, which is diagrammatically depicted in FIGS. 1-4 and 10.

Figures 3, 4:
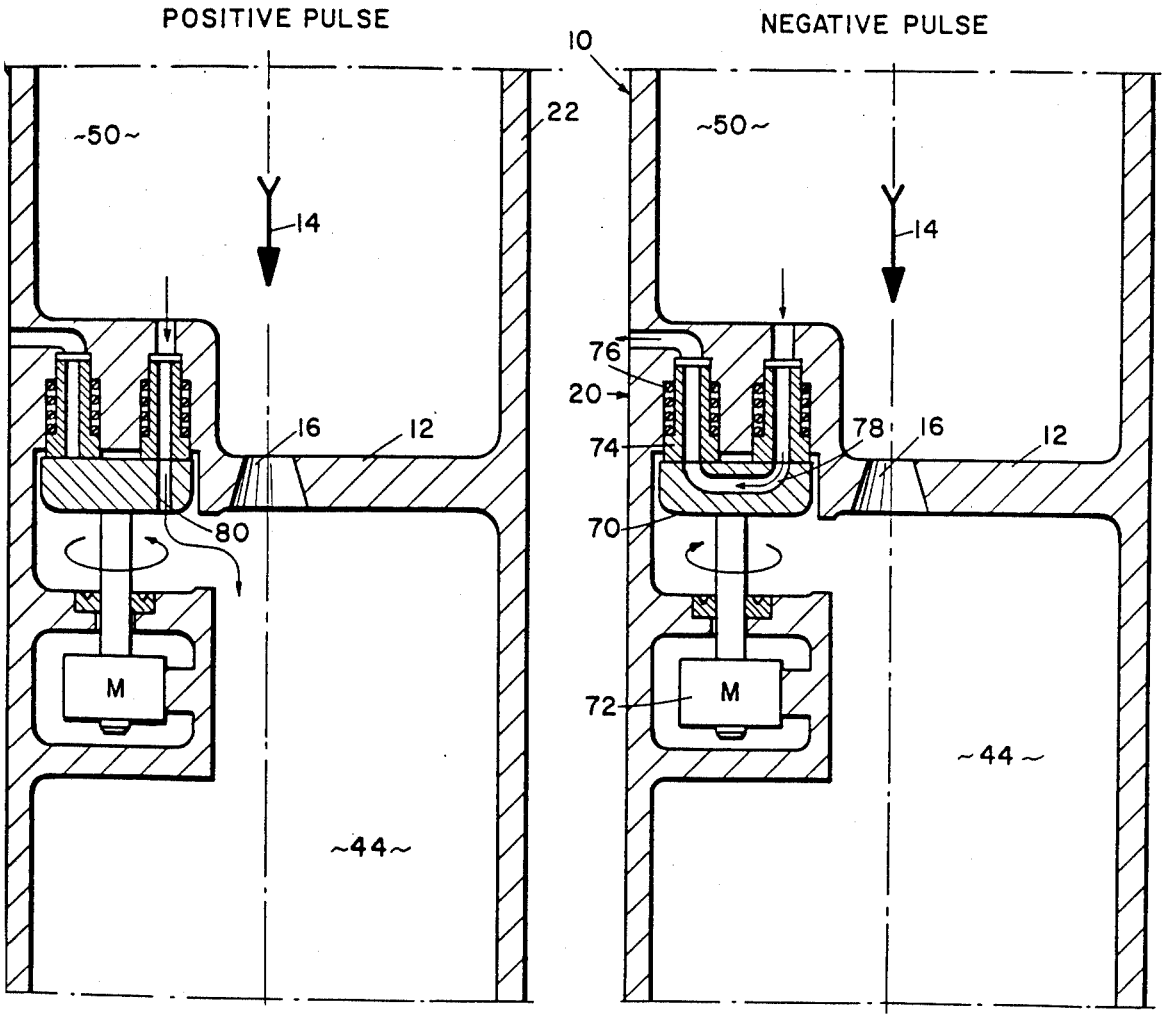
FIG. 3 is a cross-sectional depiction of the drill string shown in FIG. 2 in a configuration wherein a negative pulse is being generated.
FIG. 4 s a cross-sectional depiction of the drill string shown in FIG. 2 in a configuration wherein a positive pulse is being generated.
Figure 10:
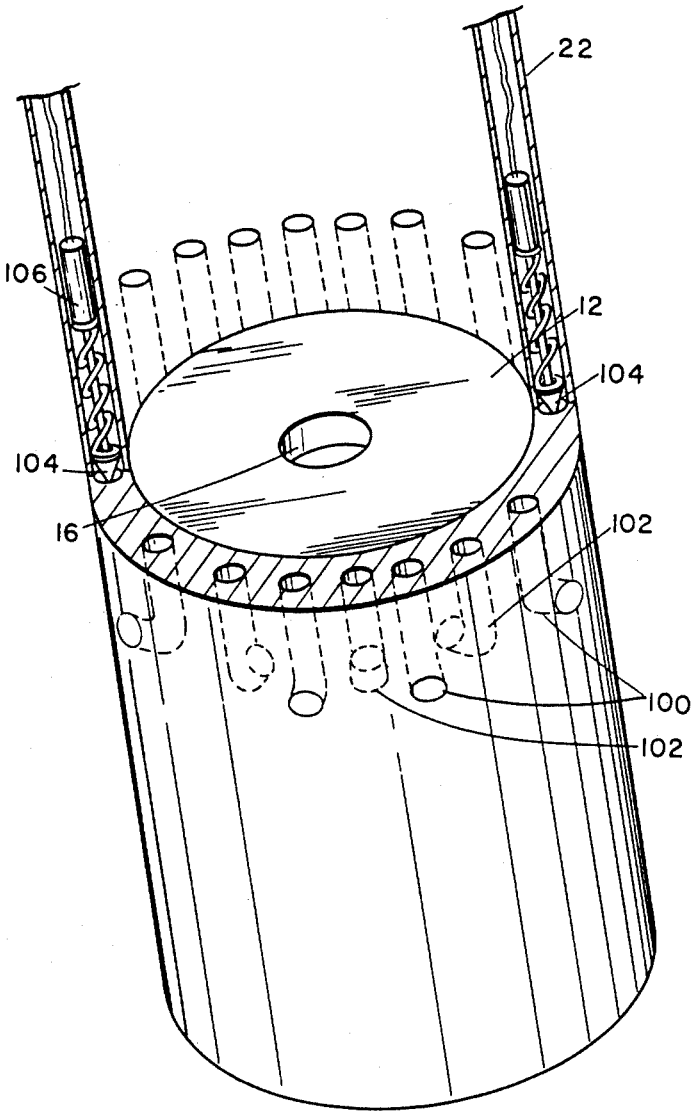
FIG. 10 is a cut-away perspective, diagrammatic view of a third embodiment of a drill string incorporating the invention.

FIG. 1 is a diagrammatic depiction of a poppet valve mechanism. FIGS. 2-4 show the use of a rotatable valve mechanism. FIG. 10 illustrates a multiport structure. In particular, FIG. 3 shows the valve in a configuration which produces a negative pulse. Rotor 70 is turned by motor 72 in FIG. 3 to divert a fraction of the mud flow from the cavity upstream from restriction 12 to annulus 36 through a first U-shaped passage 78 defined in rotor 70. Motor 72 is controlled and powered downhole by conventional means. Spring loaded shear seals 74 and O-rings 76 are provided in combination with rotor 70 to prevent leakage. Rotor 70 is turned by motor 72 in FIG. 4 to bypass a fraction of the mud flow in the cavity upstream from restriction 12 to a point downstream from restriction 12 through a second straight passage 80 defined in rotor 70. A third passage could be similarly defined in rotor 70 to simultaneously divert a fraction of the mud flow to both annulus 36 and downstream cavity 44.

Return to the embodiment of FIG. 1 and consider the operation of the pulsing system. For the purposes of clarity and simplicity, the valving mechanism has been shown in FIG. 1 as disposed within a housing 20. Within housing 20 is plurality of valves. In the illustrated embodiment, housing 20 diagrammatically includes a negative pressure valve 24 and a positive pressure valve 26. In the illustrated embodiment, both valves 24 and 26 are depicted as spring loaded, poppet valves which are electromechanically actuated through a solenoid. Housing 20 further includes a manifold block 28 through which a corresponding plurality of bypass passages are defined. For example, negative pressure valve 24 is used to selectively open and close the input aperture 30 of a negative bypass passage 32 whose output aperture 34 communicates with the annular space 36 between the outside of drill casing 22 and the borehole. Similarly, positive valve 26 is employed to selectively seal the input aperture 38 of a positive bypass passage 40 whose output aperture 42 communicates with the interior 44 of drill string 10 downstream from restriction 12. The upper portion of housing 20 is provided with a distribution manifold 46 which communicates through an aperture 48 with the interior 50 of drill string 10 upstream from restriction 12.

Therefore, with both valves 24 and 26 in a closed position as depicted in FIG. 1, there is no hydraulic flow through passages 32 or 40 and the pressure level set up within drill string 10 is the Pl pressure level determined by restriction 12 as well as by the drill bit.

Figure 5:
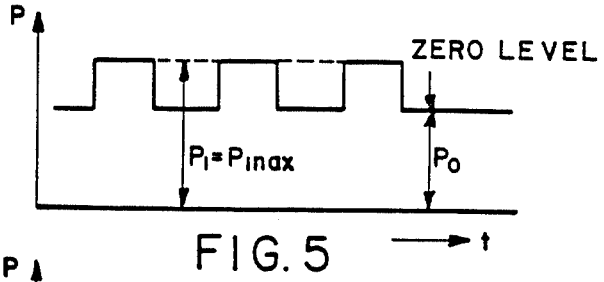
FIG. 5 is a graph of the pressure of the hydraulic mud in the drill string and as measured against time and as seen at the well surface when operated in a mode according to the method of the invention to produce positive pulses.

However, when positive pressure valve 26 is opened, hydraulic fluid is free to flow from interior 50 of drill string 10 upstream from restriction 12 through aperture 48 into manifold 46. From manifold 46 hydraulic fluid then flows through aperture 38 of passage 40 and then out output aperture 42 into interior 44 of drill string downstream from restriction 12. The result of valve 26 opening is that the pressure above restriction 12 will be P0 (as shown in FIG. 5). Thus, the closing and opening of valve 26 causes positive pressure pulses within drill string 10 with an amplitude of P1 - P0 as illustrated in FIG. 5.

Figure 7:
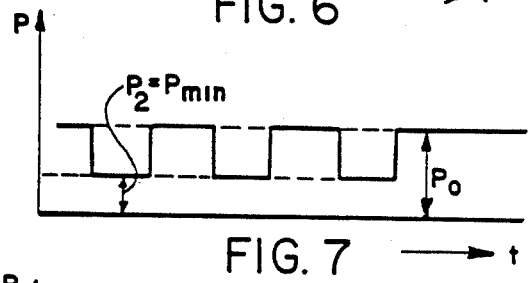
FIG. 7 is a graph of the pressure of the hydraulic mud in the drill string and as measured against time and as seen at the well surface when operated in a mode according to the method of the invention to produce negative pulses.

If positive pressure valve 26 remains open and negative pressure valve 24 selectively opens, hydraulic fluid is once again free to flow from interior 50 of drill string upstream from restriction 12 through aperture 48 into manifold 46. Hydraulic fluid then continues into apertures 30 and 38 of passage 32 and 40 and then out output apertures 34 and 42. A percentage of the hydraulic fluid is then drawn from drill string 10 into annular space 36 between the drill string and the borehole. This results in the creation of a negative pressure pulse within drill string 10, namely a pressure pulse with an amplitude P0 - P2 below that established as the basal or normal level, P0 as seen in FIG. 7.

Figure 8:
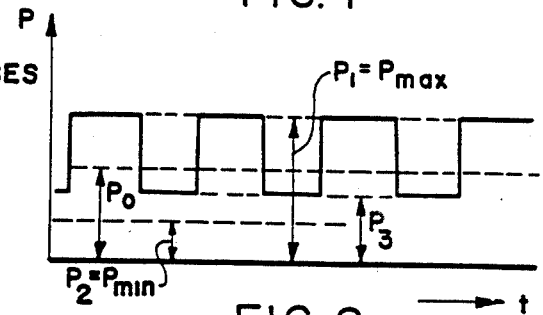
FIG. 8 is a graph of the pressure of the hydraulic mud in the drill string and as measured against time and as seen at the well surface when operated in a mode according to the method of the invention to produce negative pulses from a maximum ressure level.

If positive valve 26 remains closed and instead negative valve 24 selectively opens, the hydraulic fluid is once again free to flow from interior 50 of the drill string upstream from restriction 12 through aperture 40 into manifold 46. Hydraulic fluid then continues into aperture 30 of passage 32 and then out output aperture 34. This results in the creation of a negative pressure pulse with the amplitude of P1 - P3 as seen in FIG. 8.

Figure 6:
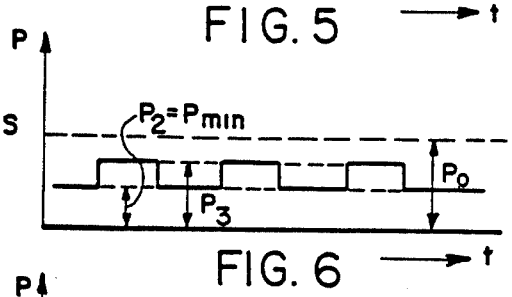
FIG. 6 is a graph of the pressure of the hydraulic mud in the drill string and as measured against time and as seen at the well surface when operated in a mode according to the method of the invention to produce positive pulses from the lowest level of pressure.

If negative valve 24 remains open and positive valve 26 selectivel opens, the result will be positive pressure pulses with an amplitude of P3 - P2 as seen in FIG. 6.

Figure 9:
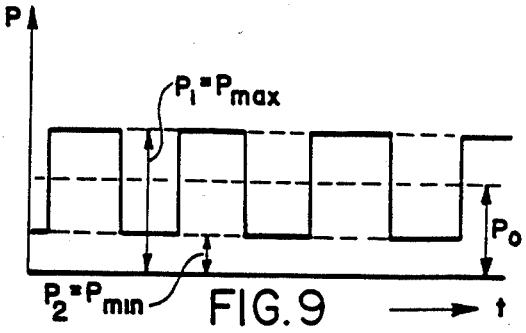
FIG. 9 is a graph of the pressure of the hydraulic mud in the drill string and as measured against time and as seen at the well surface when operated in a mode according to the method of the invention to produce doulbled pulses.

If positive valve 26 and negative valve 24 work simultaneously i.e both valves open and close together, the result is doulbed pressure pulses with a maximum amplitude of P1 - P2 as seen in FIG. 9.

In either case, the amount of hydraulic fluid flowing through valves 24 and 26 is small compare to the amount of fluid flowing in the primary flow 14 through restriction 12. Therefore, valving mechanism 18 is required to provide valving for a small amount of flow. Furthermore, the power necessary to drive valves 24 and 26 with respect to such secondary flows is correspondingly decreased as compared to the levels that would be required to power valving in the main flow 14 of the hydraulic mud as is typical of prior art.

Therefore, it can be readily understood that by selectively operating either one or the other of valves 24 and 26 as seen in FIG. 1, while the remaining valve remains open or in the nonenergized closed position, or by the simultaneous operation of both valves, the apparatus of FIG. 1 is used either solely as a positive pressure telemetry system or as a negative pressure telemetry system, or as a trinary code system or as a quadruple state system capable of having four pressure states: P0, P1, P2, and P3.

FIG. 2 is a second embodiment wherein the poppet valve assembly of FIG. 1 has been replaced by a rotating valve. By turning multistate valve 60 as shown in FIG. 2, cavity 50 above restriction 12 is communicated with the cavity below restriction 12, annulus 36 or simultaneously with restriction 12 and annulus 36. It is thus possible to get the four different types of pressure pulses as seen in FIGS. 5–9.

It is entirely within the scope of the invention that a plurality of valves each type could be included within valve mechanism 18. Therefore, any one or a number of a series of negative or positive pressure valves only could be opened to selectively create a selected one of a stepped series of negative and positive pressure levels respectively. In each case, the orifice size or net flow rate is determined in part by a corresponding bypass passage for each one of a plurality of valves and therefore can be varied to create the stepped variation in degrees of positive and negative pressures.

Turn to FIG. 10. For example, a plurality of both positive and negative bypass passages 100-102 with corresponding valves 104 could be circumferentially incorporated within the walls of casing 22. Passage 100 communicates the interior of casing 22 to the annulus and is therefore part of a negative pulsing means. Passage 102 communicates with the interior of casing 22 and bypasses restriction 12, and is therefore part of a positive pulsing means. Valves 104 could be selectively operated by a corresponding solenoid 106. Each of these bypass passages could have a varying diameter or have a identical diameters with restricter disposed within them of varying with degrees of restriction. Any one of these valves can then be selectively operated to create a corresponding selected negative or positive pressure. A large plurality of pressure levels could then be created with still only one of the entire plurality of valves being opened at any one time. The only limitation upon the fineness of gradation of pressure levels which can thus be created by the apparatus and the methodology of the invention is the degree of distinction that can be made in mud pulse pressures at the well surface by conventional sensing equipment.

Many modifications and alterations may be made by those having ordinary skill in the art without departing from the spirit and scope of the invention. The illustrated embodiment has been set forth in highly diagrammatic form only to illustrate the broad principle of the invention and should not be taken as limiting the invention which is defined in the following claims.

I claim:

1. An apparatus for generating positive mud pulse telemetry signals in a drill string having a flow of hydraulic fluid therethrough comprising:

first fixed means for restricting said flow through said drill string, said first means being disposed in said flow;

second means for selectively reducing restriction of said flow, said second means disposed outside of said flow, but in fluidic communication with said flow, and selectively diverting a portion of said flow from said first means but maintaining said diverted portion of said flow within said drill string so that said first means is ineffective to restrict said diverted portion of said flow and the restriction of said flow by said first means is reduced, said diverted flow through said second means being substantially less than said flow through said drill string, whereby erosion of said second means is reduced.

2. An apparatus for generating positive mud pulses within a drill string having a flow of hydraulic fluid therethrough comprising:

first first means for providing a partial barrier to said flow through said drill string, a differential pressure being generated across said first means, said first means being disposed in said flow within said drill string; and second means for selectively reducing said pressure differential across said first means, at most only a minority fraction of said flow of hydraulic fluid through said drill string flowing through said second means, said second means being disposed outside of said flow; but in fluidic communication with said flow within said drill string, whereby said positive pressure pulses are generated with substantially reduced erosive wear on said second means.

3. The apparatus of claim 2 wherein said second means selectively reduces said pressure differential by selectively bypassing said minority fraction of said flow around said first means, said minority fraction of said flow being withdrawn upstream from said first means and rejoining with said flow within said drill string downstream from said first means.

4. The apparatus of claim 2 wherein said second means comprises a valve and a bypass passage, said valve disposed in said bypass passage to selectively open and close said bypass passage, said bypass passage fluidically communicating said flow upstream of said first means with said flow downstream of said first means.

5. The apparatus of claim 3 wherein said second means comprises a valve and a bypass passage, said valve disposed in said bypass passage to selectively open and close said bypass passage, said bypass passage fluidically communicating said flow upstream of said first means with said flow downstream of said first means.

6. The apparatus of claim 2 wherein said first means is a barrier disposed across said drill string completely blocking said flow through said drill string except for a fixed aperture defined through said barrier, said fixed aperture having a diameter larger than the largest aggregation of solid matter entrained within said flow so that said aperture within said barrier remains substantially free of blockage at all times.

7. The apparatus of claim 3 wherein said first means is a barrier disposed across said drill string completely blocking said flow through said drill string except for a fixed aperture defined through said barrier, said fixed aperture having a diameter larger than the largest aggregation of solid matter entrained within said flow so that said aperture within said barrier remains substantially free of blockage at all times.

8. The apparatus of claim 4 wherein said first means is a barrier disposed across said drill string completely blocking said flow through said drill string except for a fixed aperture defined through said barrier, said fixed aperture having a diameter larger than the largest aggregation of solid matter and trained within said flow so that said aperture within said barrier remains substantially free of blockage at all times.

9. The apparatus of claim 4 wherein said bypass chamber includes a housing, and said valve is a solenoid operated spring loaded poppet valve, said housing fluidically communicating the said flow upstream of said first means and said spring loaded poppet valve being biased into said passage in a closed configuration.

10. The apparatus of claim 4 wherein said valve is a motor driven rotary valve with at least one valve aperture defined therethrough and said bypass passage includes a shear seal in sealing contact with said rotary valve, said aperture through said rotary valve being selectively alignable with said shear seal in said bypass passage.

* * * * *